US011032900B2

(12) United States Patent
Shin et al.

(10) Patent No.: US 11,032,900 B2
(45) Date of Patent: Jun. 8, 2021

(54) PLASMA TORCH WITH STRUCTURE CAPABLE OF PERFORMING REVERSED POLARITY/STRAIGHT POLARITY OPERATION

(71) Applicant: KOREA HYDRO & NUCLEAR POWER CO., LTD., Gyeongju-si (KR)

(72) Inventors: Sang-Woon Shin, Uijeongbu-si (KR); Cheon-Woo Kim, Daejeon (KR); Hyun-Je Cho, Seoul (KR); Young-Hwan Hwang, Seoul (KR); Seokju Hwang, Uijeongbu-si (KR)

(73) Assignee: KOREA HYDRO & NUCLEAR POWER CO., LTD., Gyeongju-si (KR)

( * ) Notice: Subject to any disclaimer, the term of this patent is extended or adjusted under 35 U.S.C. 154(b) by 641 days.

(21) Appl. No.: 15/559,588

(22) PCT Filed: Sep. 17, 2015

(86) PCT No.: PCT/KR2015/009777
§ 371 (c)(1),
(2) Date: Sep. 19, 2017

(87) PCT Pub. No.: WO2016/159463
PCT Pub. Date: Oct. 6, 2016

(65) Prior Publication Data

US 2018/0049303 A1 Feb. 15, 2018

(30) Foreign Application Priority Data

Mar. 27, 2015 (KR) ..... 10-2015-0043103

(51) Int. Cl.
*H05H 1/34* (2006.01)
*F23G 5/08* (2006.01)
(Continued)

(52) U.S. Cl.
CPC ..... *H05H 1/34* (2013.01); *F23G 5/085* (2013.01); *H05H 1/26* (2013.01); *H05H 1/28* (2013.01); *H05H 1/36* (2013.01); *H05H 1/44* (2013.01)

(58) Field of Classification Search
CPC .. H05H 1/26; H05H 1/34; H05H 1/44; H05H 1/28; H05H 1/36; F23G 5/085
(Continued)

(56) References Cited

U.S. PATENT DOCUMENTS 3,027,446 A * 3/1962 Browning ..... H05H 1/34 219/75
3,443,732 A * 5/1969 Wall, Jr. ..... B23K 9/12 228/7
(Continued)

FOREIGN PATENT DOCUMENTS

CN 201437713 U 4/2010
CN 201634692 U 11/2010
(Continued)

OTHER PUBLICATIONS

Chinese Office Action dated Nov. 16, 2018.
Japanese Office Action dated Aug. 21, 2018.
Supplementary European Search Report dated Jul. 25, 2018.

*Primary Examiner* — Dana Ross
*Assistant Examiner* — Kuangyue Chen
(74) *Attorney, Agent, or Firm* — Rabin & Berdo, P.C.

(57) ABSTRACT

Disclosed is a plasma torch with a structure capable of performing reversed polarity/straight polarity operation, wherein the plasma torch is coupled to a melter and melts a waste material such as radioactive waste or industrial waste by generating and sustaining a plasma arc between electrodes, the plasma torch including: a rear electrode provided inside a torch pipe and electrically connected to become one of an anode and a cathode; and a front electrode provided at
(Continued)

a front end of the torch pipe at a position adjacent to a front end of the rear electrode and electrically connected to become a remaining one of the anode and the cathode, wherein electrical connections of the rear and front electrodes are switchable with each other so that the plasma torch operates as a reversed polarity plasma torch or a straight polarity plasma torch.

19 Claims, 5 Drawing Sheets

(51) Int. Cl.
*H05H 1/36* (2006.01)
*H05H 1/28* (2006.01)
*H05H 1/26* (2006.01)
*H05H 1/44* (2006.01)

(58) Field of Classification Search
USPC ..... 219/121.37
See application file for complete search history.

(56) References Cited

U.S. PATENT DOCUMENTS 5,548,611 A * 8/1996 Cusick ..... B09B 3/0066 373/18
6,355,904 B1 * 3/2002 Batdorf ..... B09B 3/00 110/346
2003/0080097 A1 * 5/2003 Boulos ..... H05H 1/30 219/121.49

FOREIGN PATENT DOCUMENTS

| | | | | |
|---|---|---|---|---|
| CN | 203429195 | U | | 2/2014 |
| CN | 104197308 | A | | 12/2014 |
| CN | 104197328 | A | | 12/2014 |
| EP | 0625869 | A2 | | 11/1994 |
| EP | 1 375 628 | A2 | | 1/2004 |
| JP | 05-125460 | A | | 5/1993 |
| JP | 08-039256 | A | | 2/1996 |
| JP | 08039256 | A | * | 2/1996 |
| JP | 2003-302034 | A | | 10/2003 |
| JP | 2004-156819 | A | | 6/2004 |
| JP | 2006-052916 | A | | 2/2006 |
| JP | 2006-292333 | A | | 10/2006 |
| JP | 2012-040520 | A | | 3/2012 |
| JP | 2012040520 | A | * | 3/2012 |
| KR | 10-2001-0078636 | A | | 8/2001 |
| KR | 10-2007-0025139 | A | | 3/2007 |
| KR | 10-2010-0059378 | A | | 6/2010 |
| KR | 10-2010-0079483 | A | | 7/2010 |
| KR | 10-2012-0029495 | A | | 3/2012 |
| KR | 10-1340439 | B1 | | 12/2013 |

* cited by examiner

PLASMA TORCH WITH STRUCTURE CAPABLE OF PERFORMING REVERSED POLARITY/STRAIGHT POLARITY OPERATION

TECHNICAL FIELD

The present invention relates to a plasma torch of a melter for melting radioactive waste and general industrial waste. More particularly, the present invention relates to a plasma torch with a structure capable of performing reversed polarity/straight polarity operation, wherein the plasma torch includes a hollow-type rear electrode being blocked at one end and having a hollow portion inside, and a nozzle-type front electrode being open at opposite ends, such that the plasma torch can operate as a reverse polarity plasma torch or a straight polarity plasma torch according to an electrical connection.

BACKGROUND ART

In general, a melter using a plasma torch is used to treat combustible and non-combustible materials such as metals and concrete, etc. of radioactive waste generated from a nuclear power plant, whereby the radioactive waste is reduced in volume and is stabilized to be disposed in a waste disposal site.

The aforementioned plasma torch is a device for generating and sustaining a plasma arc between electrodes, and it plays a role of accelerating ionization and phase change of an object by providing energy (mainly in the form of thermal energy) and reactive gas.

Meanwhile, as described above, the plasma arc generated between the electrodes is generally utilized according to applications by injecting various gases (argon, nitrogen, oxygen, compressed air, etc.) while controlling a flow velocity and a flow rate of gas.

Further, the plasma torch as described above may be classified into various types according to its structure and shape, and may be classified into a straight polarity and a reverse polarity plasma torch and into a transferred and a non-transferred plasma torch according to the arrangement of the electrodes.

In particular, an industrial plasma torch for waste treatment or melting mainly adopts a hollow-type torch, which is a high-temperature pollution-free heat source and efficiently controls a temperature and a speed of plasma.

In the structure of the torch described above, the non-transferred torch operates stably without being influenced by the object, whereas energy transfer efficiency of the object is reduced. The transferred torch operates only when the object has conductivity, and operation thereof is unstable because an arc is influenced by the environment, for example, external gas. However, energy transfer efficiency of the object is high.

Accordingly, in order to overcome the disadvantages described above, generally, the non-transferred torch is used as a means for heating a non-metal material, and the transferred torch is used as a means for heating a metal material.

Meanwhile, the plasma torch according to the related art is structured, generally, such that a front electrode is electrically connected to become an anode and a rear electrode is electrically connected to become a cathode so that the torch operates as a straight polarity plasma torch.

On the other hand, a reversed polarity plasma torch is structured such that the rear electrode is electrically connected to become an anode and the front electrode is electrically connected to become a cathode, so that the front electrode is relatively easy to replace and an operating voltage can be increased. Accordingly, the reversed polarity plasma torch is used in high-power plasma applications.

Currently, a waste treatment technique using plasma torches is currently being utilized variously in facilities such as Zwilag in Switzerland, Radon in Russia, and Tsuruga nuclear power plant in Japan. Recently, high-power plasma torches and techniques using the same have been studied in order to treat various wastes efficiently and safely with high yield.

DOCUMENTS OF RELATED ART

Patent Documents

1. Korean Patent No. 10-1340439 (published on Dec. 11, 2013)
2. Korean Patent Application Publication No. 2012-0029495 (published on Mar. 27, 2012)
3. Korean Patent Application Publication No. 2001-0078636 (published on Aug. 21, 2001)

DISCLOSURE

Technical Problem

Accordingly, the present invention has been made keeping in mind the above problems occurring in the prior art, and an object of the present invention is to provide a plasma torch with a structure capable of performing reversed polarity/straight polarity operation, wherein the disposal volume of varied (conductive, non-conductive, etc.) waste such as radioactive waste, industrial waste, etc. is increased through a high temperature melting operation.

Another object of the present invention is to ensure ease of operation, stability, and convenience of the treatment facility by efficiently and uniformly delivering energy into the melter.

A further object of the present invention is to ensure efficient and stable operation of the melter using the plasma torch.

Yet another object of the present invention is to enable economical and efficient treatment through a long-term operation at a high temperature when melting radioactive waste, general industrial waste, etc. in the plasma melter.

Still another object of the present invention is to improve the configuration, operating method, and process of the plasma torch for enabling efficient waste treatment.

Technical Solution

In order to accomplish the above object, the present invention provides a plasma torch with a structure capable of reversed polarity/straight polarity operation, wherein the plasma torch is coupled to a melter and melts a waste material such as radioactive waste or industrial waste by generating and sustaining a plasma arc between electrodes, the plasma torch including: a rear electrode provided inside a torch pipe and electrically connected to become one of an anode and a cathode; and a front electrode provided at a front end of the torch pipe at a position adjacent to a front end of the rear electrode and electrically connected to become a remaining one of the anode and the cathode, wherein electrical connections of the rear and front electrodes are switchable with each other so that the plasma torch operates as a reversed polarity plasma torch or a straight polarity plasma torch.

The plasma torch according to the present invention as described above further includes: a first-shaft torch feed means linearly feeding the plasma torch. Here, the first-shaft torch feed means may include: a first-shaft linear motion (LW guide guiding the plasma torch to move linearly; a first-shaft guide block provided on the first-shaft LM guide to be movable linearly and fixedly supporting on an upper portion thereof the plasma torch; a first-shaft ball screw coupled to the first-shaft guide block by passing therethrough and linearly moving the first-shaft guide block forward and backward through normal and reverse rotation; and a first-shaft servo motor connected to an end of the first-shaft ball screw and rotating in normal and reverse directions by application of power to rotate the first-shaft ball screw in the normal and reverse directions.

Meanwhile, the plasma torch according to the present invention as described above further includes: a second-shaft torch rotation angle adjustment means adjusting a rotation angle of the plasma torch when the plasma torch is coupled to the melter. Here, the second-shaft torch rotation angle adjustment means may include: a second-shaft support having a predetermined height and provided at a side of the melter; a second-shaft connection link rotatably coupled to an upper end of the second-shaft support; a second-shaft length adjustment means rotatably coupled to an end of the second-shaft connection link, and adjusting an angle of the plasma torch through length adjustment; and a second-shaft support link rotatably coupled at opposite ends thereof to an end of the second-shaft length adjustment means and to a side of the melter, and supporting the first-shaft torch feed means.

Further, the second-shaft length adjustment means may include: a second-shaft connection bar rotatably coupled to an end of the second-shaft connection link; a second-shaft LM guide coupled to the second-shaft connection bar; a second-shaft guide block provided on the second-shaft LM guide to be movable linearly forward and backward; a second-shaft moving bar provided on the second-shaft guide block and rotatably coupled to the second-shaft support link; a second-shaft ball screw coupled to the second-shaft guide block by passing therethrough and linearly moving the second-shaft guide block forward and backward through normal and reverse rotation; and a second-shaft servo motor connected to an end of the second-shaft ball screw, and rotating in the normal and reverse directions by application of power to rotate the second-shaft ball screw in the normal and reverse directions.

In addition, when the plasma torch may operate with reversed polarity, an anode spot is fixed without movement on a surface of the rear electrode.

When the plasma arc is generated by a discharge gas injected between the rear and front electrodes, an arc length may increase by moving a cathode spot to a desired position through a flow of plasma gas.

The rear and front electrodes may be made of any one of oxygen-free copper, tungsten, graphite, molybdenum, and silver materials depending on use.

Further, the rear and front electrodes may be designed to have a multi-bar type structure in which a water-cooled conductive coil designed to allow a maximum current of several hundred amperes or more to flow into the rear and front electrodes is wound several times or more, so that a high speed rotation of an arc spot and current density dispersion are induced by a strong magnetic field generated in an axial direction of the electrodes.

Further, the rear and front electrodes may have a protruding or depressed structure, the rear electrode being formed in a hollow shape in which an end thereof is blocked and an inside thereof is hollow, and the front electrode being formed in a nozzle shape in which opposite ends thereof are open.

The melter may have two plasma torches operating by one power source, the two plasma torches operating in an operation state and a pre-heating state, respectively, such that when one of the two plasma torches stops operation or an output thereof decreases, a remaining one of the plasma torches operates by replacing the one of the plasma torches.

In addition, the plasma torch may operate as a transferred torch, a non-transferred torch, or a combination torch to perform treatment of non-conductive waste or conductive waste.

Moreover, the plasma torch according to the present invention may be initially ignited by using argon gas as a discharge gas and is switched to a non-transferred mode by using nitrogen gas, the plasma torch operating in a transferred or combination mode with a current equal to or greater than a certain level.

Further, the plasma torch according to the present invention may perform an operation for destroying or melting a waste drum charged into the melter.

The plasma torch may be configured to be movable during operation thereof. In addition, the plasma torch may be configured to be freely adjustable in movement distance inside the melter during operation thereof.

In addition, the plasma torch according to the present invention may be configured to be hermetically and rotatably coupled to the melter by using a ball joint bearing, and reversed polarity and straight polarity operations of the plasma torch may be freely switchable with each other during operation of the torch.

Advantageous Effects

According to the present invention, it is possible to increase the disposal volume of varied (conductive, non-conductive, etc.) waste such as radioactive waste, industrial waste, etc. through the high temperature melting operation.

Further, according to the present invention, it is possible to ensure ease of operation, stability, and convenience of the treatment facility by efficiently and uniformly delivering energy into the melter, and to ensure efficient and stable operation of the melter using the plasma torch.

In addition, according to the present invention, it is possible to enable economical and efficient treatment through the long-term operation at a high temperature when melting radioactive waste, general industrial waste, etc. in the plasma melter.

Further, according to the present invention, it is possible to enable efficient waste treatment by improving the configuration, operating method, and process of the plasma torch.

BEST MODE

Hereinafter, preferred embodiments of a plasma torch with a structure capable of performing reversed polarity/straight polarity operation according to the present invention will be described in detail with reference to the accompanying drawings.

Figure 1:
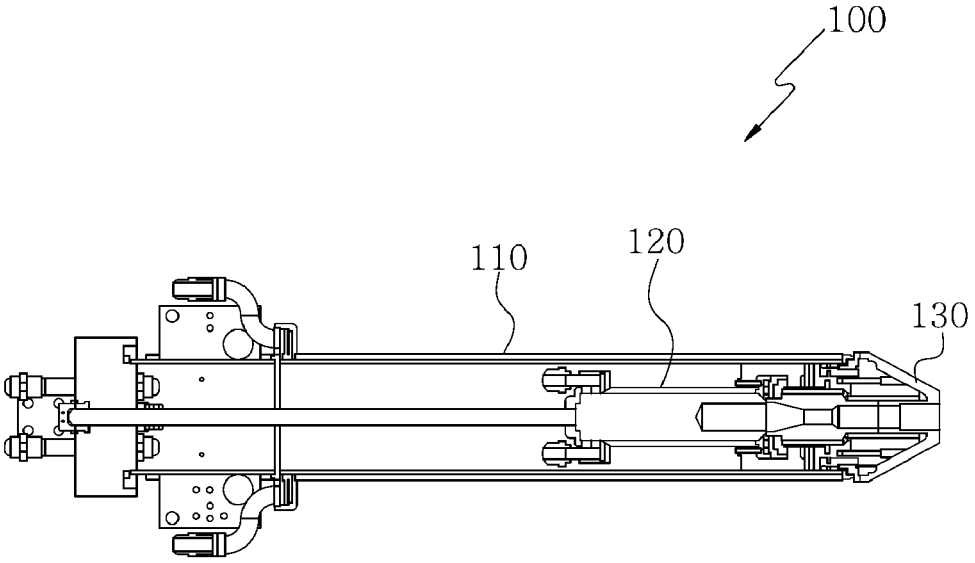
FIG. 1 is a cross-sectional view showing a plasma torch with a structure capable of performing reversed polarity/straight polarity operation according to the present invention.
Figure 2:
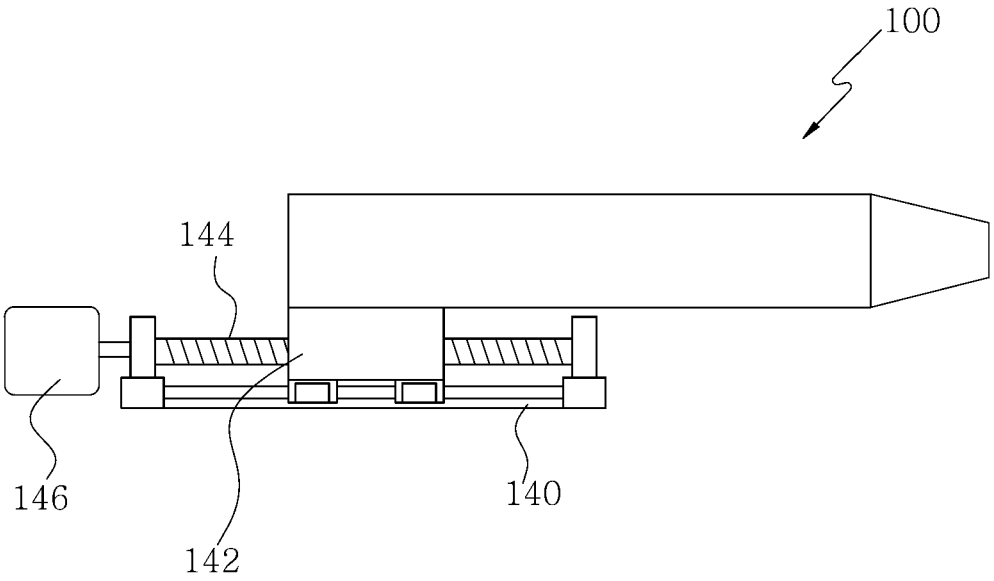
FIG. 2 is a side view showing a forward/backward feed means of the plasma torch with the structure capable of performing reversed polarity/straight polarity operation according to the present invention.
Figure 3:
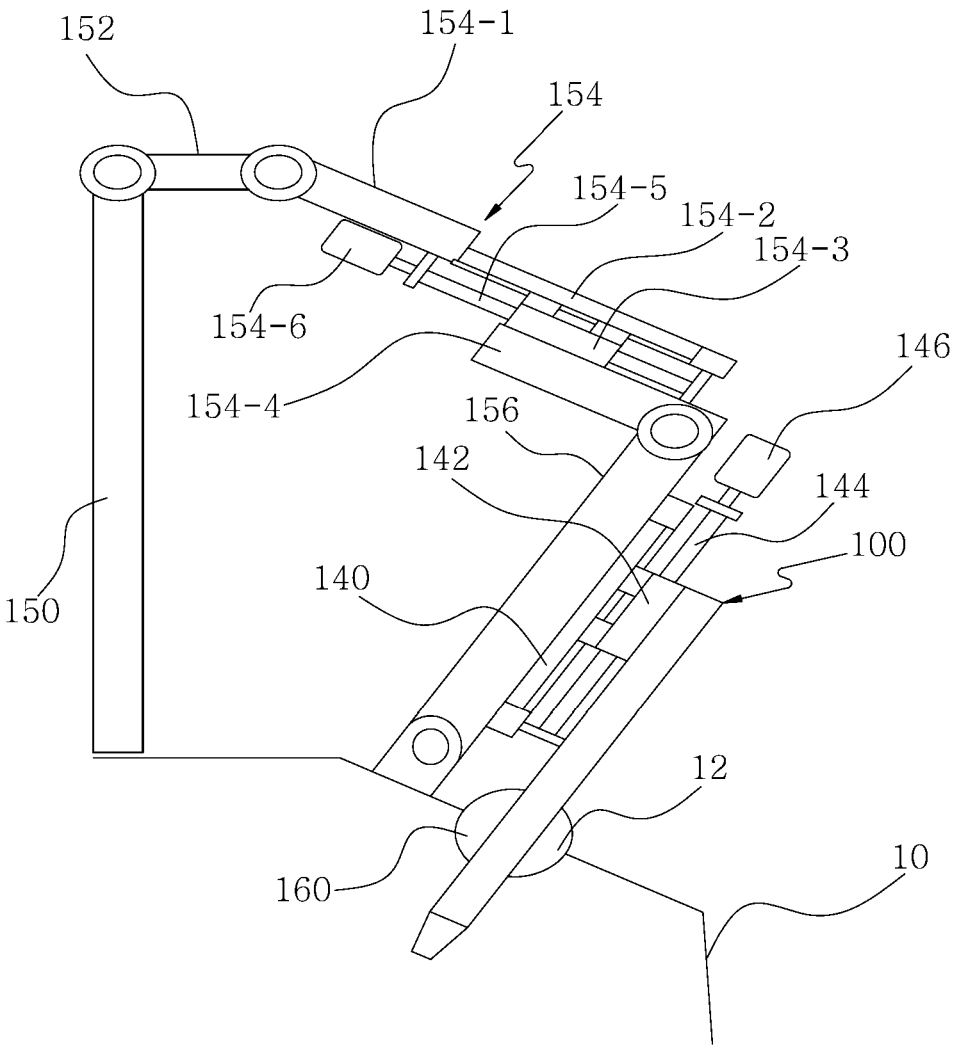
FIG. 3 is a side view showing an angle adjustment means with a first shaft and a second shaft for feeding the plasma torch with the structure capable of performing reversed polarity/straight polarity operation.
Figure 4:
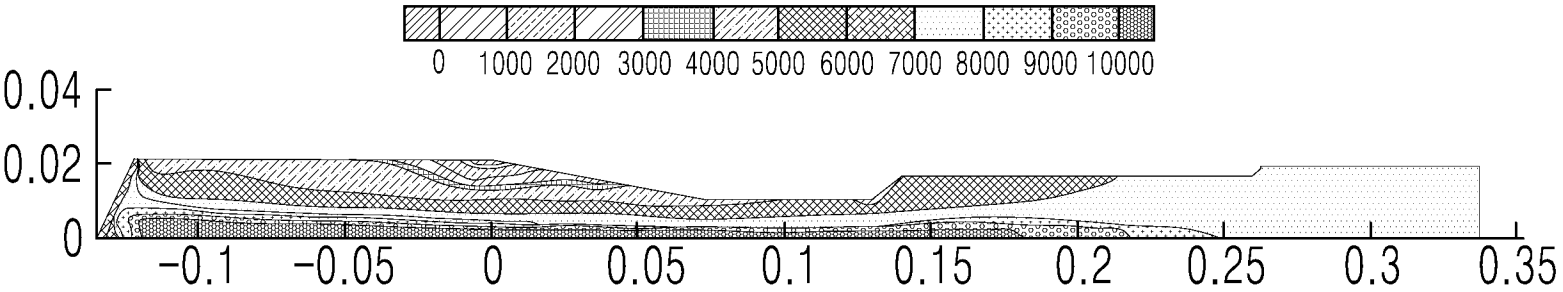
FIG. 4 is a graph showing a result of temperature distribution analysis in a hollow-type reversed polarity plasma torch according to the present invention under conditions of an input current of 800 A and a gas flow rate of 1,500 slpm (output of 1.10 MW).
Figure 5:
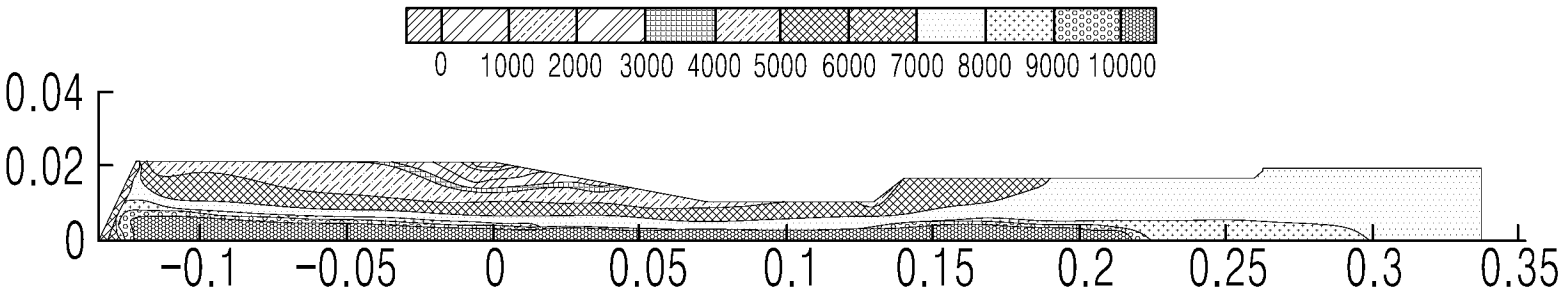
FIG. 5 is a graph showing a result of temperature distribution analysis in the hollow-type reversed polarity plasma torch according to the present invention under conditions of an input current of 1,000 A and a gas flow rate of 1,500 slpm (output of 1.27 MW).

FIG. 1 is a cross-sectional view showing the plasma torch with the structure capable of performing reversed polarity/straight polarity operation according to the present invention, FIG. 2 is a side view showing a forward/backward feed means of the plasma torch with the structure capable of performing reversed polarity/straight polarity operation according to the present invention, FIG. 3 is a side view showing an angle adjustment means with a first shaft and a second shaft for feeding the plasma torch with the structure capable of performing reversed polarity/straight polarity operation, FIG. 4 is a graph showing a result of temperature distribution analysis in a hollow-type reversed polarity plasma torch according to the present invention under conditions of an input current of 800 A and a gas flow rate of 1,500 slpm (output of 1.10 MW), and FIG. 5 is a graph showing a result of temperature distribution analysis in the hollow-type reversed polarity plasma torch according to the present invention under conditions of an input current of 1,000 A and a gas flow rate of 1,500 slpm (output of 1.27 MW).

As shown in FIGS. 1 to 3, the plasma torch 100 capable of performing reversed polarity/straight polarity operation according to the present invention is a technique wherein the plasma torch operates with reversed polarity or straight polarity according to an electrical connection as previously mentioned in the objects of the present invention. The plasma torch is configured such that a rear electrode 120 provided inside a torch pipe 110 and electrically connected to become one of an anode and a cathode, and a front electrode 130 provided at a front end of the torch pipe 110 at a position adjacent to a front end of the rear electrode 120 and electrically connected to become a remaining one of the anode and the cathode, wherein electrical connections of the rear electrode 120 and the front electrode 130 are switchable with each other so that the plasma torch operates as a reversed polarity plasma torch or a straight polarity plasma torch.

In the plasma torch 100 capable of performing reversed polarity/straight polarity operation according to the present invention as described above, the rear electrode 120 is formed in a hollow shape in which one end thereof is blocked and an inside thereof is hollow, while the front electrode 130 is formed in a nozzle shape in which opposite ends thereof are open. In other words, the present invention can be regarded as a hollow-type plasma torch including a hollow-type rear electrode and a nozzle-type front electrode.

Meanwhile, the plasma torch 100 according to the present invention configured as described above has a reversed polarity plasma torch structure in which the rear electrode 120 is electrically connected to become an anode and the front electrode 130 is electrically connected to become a cathode, as opposed to an electrical connection of a general hollow-type torch. Thus, when operating as a straight polarity plasma torch, an electrical connection is switched so that the plasma torch 100 operates with straight polarity.

In other words, in the case that the plasma torch 100 capable of performing reversed polarity/straight polarity operation according to the present invention configured as described above operates as a reversed polarity plasma torch 100, the rear electrode 120 is electrically connected to become the anode while the front electrode 130 is electrically connected to become the cathode so that the plasma torch 100 operates with reversed polarity.

On the other hand, in the case that the plasma torch 100 capable of performing reversed polarity/straight polarity operation according to the present invention configured as described above operates as a straight polarity plasma torch 100, the rear electrode 120 is electrically connected to become the cathode while the front electrode 130 is electrically connected to become the anode so that the plasma torch 100 operates with straight polarity.

As described above, in the case that the reversed polarity plasma torch 100 with the structure in which as opposed to the electric connection of the general hollow-type torch, the rear electrode 120 is electrically connected to become the anode and the front electrode 130 is electrically connected to become the cathode, there is an advantage that the lifetime of the electrode can be extended, and the replacement of the worn cathode can be facilitated.

Meanwhile, the technique according to the present invention further includes a first-shaft torch feed means feeding the plasma torch 100 to be installed at the melter 10. The first-shaft torch feed means is configured to linearly feed the plasma torch 100 and includes: a first-shaft LM guide 140 for guiding the plasma torch 100 to move linearly; a first-shaft guide block 142 provided on the first-shaft LM guide 140 to be movable linearly and fixedly supporting on an upper portion thereof the plasma torch 100; a first-shaft ball screw 144 coupled to the first-shaft guide block 142 by passing therethrough and linearly moving the first-shaft guide block 142 forward and backward by normal and reverse rotation; and a first-shaft servo motor 146 connected to an end of the first-shaft ball screw 144 and rotating in normal and reverse directions by application of power to rotate the first-shaft ball screw 144 in the normal and reverse directions.

The first-shaft torch feed means structured as described above is operated such that when the plasma torch 100 is coupled to the melter 10, the first-shaft servo motor 146 is driven to rotate in the normal direction and then the first-shaft ball screw 144 rotates in the normal direction in a state in which the plasma torch 100 is placed at a corresponding position of the melter 10. Thereafter, the first-shaft guide block 142 moves forward along the first-shaft LM guide 140 while the first-shaft ball screw 144 rotates in the normal direction. Accordingly, a front end of the plasma torch 100 provided on the first-shaft guide block 142 is inserted into an installation hole 12 provided on the melter 10.

On the other hand, the first-shaft torch feed means described above is operated such that when the plasma torch 100 inserted into the installation hole 12 of the melter 10 is separated from the melter 10, the first-shaft servo motor 146 is driven to rotate in the reverse direction and then the first-shaft ball screw 144 rotates in the reverse direction. Thereafter, the first-shaft guide block 142 moves backward along the first-shaft LM guide 140 while the first-shaft ball screw 144 rotates in the reverse direction. Accordingly, the front end of the plasma torch 100 provided on the first-shaft guide block 142 is separated from the installation hole 12 of the melter 10.

As described above, when inserting the plasma torch 100 into the installation hole 12 of the melter 10 or separating the inserted plasma torch 100 from the installation hole 12 of the melter 10, the first-shaft torch feed means allows the plasma torch 100 to be inserted into the installation hole 12 of the melter 10 or to be separated from the installation hole 12 by the normal and reverse rotation of the first-shaft servo motor 146 through application of power.

Further, the technique according to the present invention further includes a second-shaft torch rotation angle adjustment means for adjusting a rotation angle of the plasma torch 100 to insert the plasma torch 100 into the installation hole 12 of the melter 10 or to return the separated plasma torch 100 to its original position. The second-shaft torch rotation angle adjustment means includes: a second-shaft support 150 having a predetermined height and provided at a side of the melter 10; a second-shaft connection link 152 rotatably coupled to an upper end of the second-shaft support 150; a second-shaft length adjustment means 154 rotatably coupled to an end of the second-shaft connection link 152 and adjusting an angle of the plasma torch 100 through length adjustment; and a second-shaft support link 156 rotatably coupled at opposite ends thereof to an end of the second-shaft length adjustment means 154 and to a side of the melter 10, and supporting the first-shaft torch feed means.

In the second-shaft torch rotation angle adjustment means as described above, the second-shaft length adjustment means 154 includes: a second-shaft connection bar 154-1 rotatably coupled to an end of the second-shaft connection link 152; a second-shaft LM guide 154-2 coupled to the second-shaft connection bar 154-1; a second-shaft guide block 154-3 provided on the second-shaft LM guide 154-2 to be movable linearly forward and backward; a second-shaft moving bar 154-4 provided on the second-shaft guide block 154-3 and rotatably coupled to a second-shaft support link 156; a second-shaft ball screw 154-5 coupled to the second-shaft guide block 154-3 by passing therethrough and linearly moving the second-shaft guide block 154-3 forward and backward through normal and reverse rotation; and a second-shaft servo motor 154-6 connected to an end of the second-shaft ball screw 154-5 and rotating in normal and reverse directions by application of power to rotate the second-shaft ball screw 154-5 in the normal and reverse directions.

As shown in FIG. 3, the torch rotation angle adjustment means as described above is operated such that when inserting the plasma torch 100 into the installation hole 12 of the melter 10 by supporting the first-shaft torch feed means through the second-shaft support link 156, the second-shaft support link 156 rotates in a first direction through the second-shaft length adjustment means 154 by extending the second-shaft length adjustment means 154, whereby the first end of the plasma torch 100 agrees with the installation hole 12 of melter 10.

Meanwhile, the second-shaft length adjustment means 154 extends to rotate the second-shaft support link 156 in the first direction as described above, and thus the first end of the plasma torch 100 agrees with the installation hole 12 of the melter 10. Then, the first-shaft ball screw 144 rotates in the normal direction through the normal rotation in accordance with the driving of the first-shaft servo motor 146 of the torch feed means. Thereafter, the first-shaft guide block 142 moves forward, and thus the front end of the plasma torch 100 is inserted into the installation hole 12 of the melter 10 by moving the first-shaft guide block 142 forward.

In the above-described configuration, the second-shaft length adjustment means 154 is operated such that the second-shaft ball screw 154-5 rotates in the normal direction through the normal rotation of the second-shaft servo motor 156-4 to move the second-shaft guide block 154-3 forward. Accordingly, the second-shaft moving bar 154-4 moves forward and thus the second-shaft support link 156 rotates in the first direction, whereby the first end of the plasma torch 100 agrees with the installation hole 12 of the melter 10.

On the other hand, as shown in FIG. 3, when separating the plasma torch 100 from the installation hole 12 of the melter 10 to return the plasma torch to its original position, first, the first-shaft ball screw 144 rotates in the reverse direction through the reverse rotation of the first-shaft servo motor 146 and the first-shaft guide block 142 moves backward, so that the plasma torch 100 is separated from the installation hole 12 of the melter 10. Then, the support link 156 rotates in a second direction through the length adjustment means 154 of the second-shaft torch rotation angle adjustment means by retracting the length adjustment means 154, whereby the plasma torch 100 is returned to its original position.

In the case that the plasma torch 100 is returned to its original position as described above, the length adjustment means 154 is operated such that the second-shaft ball screw 154-5 rotates in the reverse direction through the reverse rotation of the first-shaft servo motor 156-4 to move the first-shaft guide block 154-3 backward. Accordingly, the moving bar 154-4 moves backward and thus the support link 156 rotates in the second direction, whereby the plasma torch 100 separated from the installation hole 12 of the melter 10 is returned to its original position.

The plasma torch 100 capable of performing reversed polarity/straight polarity operation according to the present invention can operate with reversed polarity and straight polarity according to the electrical connection as previously described. The plasma torch 100 of the present invention is characterized in that as opposed to the electrical connection of the general hollow-type torch, the hollow-type rear electrode 120 is electrically connected to become the anode and the front electrode 130 is electrically connected to become the cathode in order to extend the lifetime of the electrode and facilitate the replacement of the worn cathode. That is, the technique of the present invention is characterized by the reversed polarity plasma torch 100.

Meanwhile, in the configuration of the plasma torch 100 according to the present invention as described above, a plasma arc is generated by a discharge gas injected between the two electrodes 120 and 130. Here, an anode spot is fixed without movement on the surface of the rear electrode 120, and a cathode spot can be moved to a desired position through a flow of the discharge gas. Thus, an arc length can increase through the front electrode 130 to thereby increase the operating voltage.

Consequently, the technique according to the present invention as described above is advantageous in increasing an output of plasma while suppressing a current increase, which is the main cause of erosion of the electrodes 120 and 130, and can be widely used in high-power plasma applications such as melting of radioactive waste or general industrial waste.

Moreover, in the configuration of the plasma torch 100 according to the present invention, the rear electrode 120 electrically connected to become the anode and the front electrode 130 electrically connected to become the cathode may be made of any one of oxygen-free copper, tungsten, graphite, molybdenum, and silver materials depending on the use suitable for a given situation in consideration of economic efficiency and process conditions, and a water-cooling or no-cooling method may be applied depending on the material.

Further, the facility to which the plasma torch 100 according to the present invention as described above is applied uses argon gas and nitrogen gas as a plasma ignition gas and a plasma forming gas, respectively. The operating condition is as follows: a flow rate of nitrogen gas is in a range of 0 to 2,000 slpm, a current and a voltage that are applied to the plasma torch 100 are in a range of 0 to 1,000 A and in a range of 0 to 1.5 kV, respectively, whereby a plasma torch 100 with a maximum output of 1.5 MW is implemented.

In addition, the technique according to the present invention is designed such that a thermal efficiency is equal to or greater than 70% (input power of 1.5 MW) in the transferred mode and a thermal efficiency is equal to or greater than 50% (input power of 1.0 MW) in the non-transferred mode. Moreover, in order to achieve long-time operation, the electrodes are designed to have a multi-bar type structure in which a water-cooled conductive coil designed to allow a maximum current of 500 A or more to flow into the electrodes under the relevant operation conditions is wound 10 times or more, so that a high speed rotation of an arc spot and current density dispersion are induced by a strong magnetic field generated in the axial direction of the electrodes. Based on this, when the oxygen-free copper front electrode 130 operates in the non-transferred mode of 1.0 MW, continuous operation for equal to or greater than 3 hours and an electrode loss of equal to or less than 0.05 wt % is achieved without replacement of the electrode 130.

Further, as shown in FIGS. 4 and 5, in order to improve efficiency of output, and ease and stability of a process, the technique according to the present invention optimizes the structure of the plasma torch through thermal flow analysis based on parameters such as input current and gas flow rate.

FIG. 4 shows a result of temperature distribution analysis in a hollow-type reversed polarity plasma torch 100 under the conditions of an input current of 800 A and a gas flow rate of 1,500 slpm (output of 1.10 MW).

FIG. 5 shows a result of temperature distribution analysis in the hollow-type reversed polarity plasma torch under the conditions of an input current of 1,000 A and a gas flow rate of 1,500 slpm (output of 1.27 MW).

Meanwhile, the plasma torch 100 according to the present invention may operate as a transferred torch, a non-transferred torch, or a combination torch. In the case of performing treatment of non-conductive waste, it operates as non-transferred torch to melt the waste, and then when a melt is formed, conductivity is generally ensured. In this case, it may operate as the transferred torch or the combination torch for achieving high output and a stable process.

On the other hand, in the case of performing treatment of conductive waste, it may operate as the transferred torch or the combination torch after the non-transferred operation depending on the situation, or may directly operate as the transferred torch or the combination torch when suitable conductivity is secured inside the melter 10.

In addition, in the case of the melter 10 for melting waste, two plasma torches 100 according to the present invention are installed at one melter 10. The two plasma torches 100 according to the present invention operate in an operation state and a pre-heating state, respectively. When one of the two plasma torches 100 stops operation or an output of thereof decreases, a remaining one of the plasma torches 100 may operate by replacing the one of the plasma torches.

Meanwhile, the plasma torch 100 according to the present invention is also characterized in that the plasma torch 100 capable of performing the melting operation for forming the melt is also capable of performing a destroying operation, which is a pre-treatment process for destroying a waste drum charged into the melter 10. Further, The proper injection of the plasma forming gas is achieved during operation such that the arc generated between the rear electrode 20 electrically connected to become the anode and the front electrode 130 electrically connected to become the cathode is increased to thereby increase the voltage, while the arc is stabilized to be prevented from direct contact with the inner surfaces of the first and second electrodes 120 and 130. Furthermore, the present invention is designed such that reaction with the melt and arcing on the surface of the plasma torch 100 are prevented from occurring even during reversed polarity operation.

In addition, as shown in FIG. 3, in order to efficiently transfer energy into the melter 10 and ensure the ease of operation, the technique according to the present invention is structured such that the torch feed means and the torch rotation angle adjustment means are provided as double shafts. The torch feed device having the double shafts is capable of moving forward and backward on the melter 10 and changing in angle by about 30 degrees, thereby contributing to improvement in the process simplicity and operational safety.

As shown in FIGS. 2 and 3, in the above-described configuration, the device (first shaft: torch feed means) for feeding the plasma torch 100 in the forward and backward directions is generally composed of the ball screw 144 and the LM guide 140, and the servo motor 146 is used as a motor for rotating the ball screw 144 to control the speed and the forward and backward position.

Further, as shown in FIG. 3, the second-shaft device for adjusting the angle of the plasma torch 100 according to the present invention is structured such that the forward and backward configurations of the torch rotation angle adjustment means and the forward and backward configurations of the first-shaft torch feed means are connected by a four link mechanism, whereby the second-shaft feed device moves forward and backward to adjust the rotation angle of the plasma torch 100. To this end, the plasma torch 100 is provided to pass through a ball joint bearing 160, and is designed to have an angle change of equal to or greater than 30 degrees and to be hermetically coupled to the melter 10.

In the technique according to the present invention as described above, the plasma torch 100 can move during the operation of the plasma torch 100, and also can be freely adjustable in movement distance inside the melter 10 during the operation of the plasma torch 100.

In addition, the plasma torch 100 according to the present invention can be hermetically and rotatably inserted into the installation hole 12 of the melter 10 by using the ball joint bearing 160, and reversed polarity and straight polarity operations of the plasma torch can be freely switchable with each other during the operation of the torch.

As described above, the torch feed device having the first and second shafts for feeding the plasma torch 100 according to the present invention can facilitate the formation of the melt in the melter 10 and enable efficient operation.

Although embodiments of the present invention were described in detail above, the scope of the present invention is not limited to the embodiments and various changes and modifications from the spirit of the present invention defined in the following claims by those skilled in the art are also included in the scope of the present invention.

DESCRIPTION OF THE REFERENCE NUMERALS IN THE DRAWINGS

10: melter 12: installation hole
100: plasma torch 110: torch pipe
120: rear electrode 130: front electrode
140: first-shaft LM guide
142: first-shaft guide block
144: first-shaft ball screw
146: first-shaft servo motor
150: second-shaft support
152: second-shaft connection link
154: second-shaft length adjustment means
154-1: second-shaft connection bar
154-2: second-shaft LM guide
154-3: second-shaft guide block
154-4: second-shaft moving bar
154-5: second-shaft ball screw
154-6: second-shaft servo motor
156: support link
160: ball joint bearing

What is claimed is:

1. A plasma torch with a structure capable of performing reversed polarity/straight polarity operation, wherein the plasma torch is coupled to a melter and melts a waste material such as radioactive waste or industrial waste by generating and sustaining a plasma arc between electrodes, the plasma torch comprising:

a rear electrode provided inside a torch pipe and electrically connected to become one of an anode or a cathode;

a front electrode provided at a front end of the torch pipe at a position adjacent to a front end of the rear electrode and electrically connected to become another one of the anode or the cathode; and a first-shaft torch feed means configured to linearly feed the plasma torch forward and backward in a direction parallel to a lengthwise direction of the plasma torch, wherein electrical connections of the rear and front electrodes are switchable with each other so that the plasma torch operates as a reversed polarity plasma torch or a straight polarity plasma torch, wherein the first-shaft torch feed means includes:

a first-shaft linear motion (LM) guide guiding the plasma torch to move linearly; and a first-shaft guide block provided on the first-shaft LM guide to be movable linearly and fixedly supporting on an upper portion thereof the plasma torch; and wherein a surface of the first-shaft guide block contacts a surface of the plasma torch.

2. The plasma torch of claim 1, wherein the first-shaft guide block is coupled to a rotatable second-shaft support link configured to rotate to adjust a position of the plasma torch relative to an installation hole of the melter, and wherein the rotatable second-shaft support link is coupled to a second-shaft length adjustment means including a rotatable second-shaft ball screw, a second-shaft guide block and a second-shaft servo motor, the rotatable second-shaft ball screw being configured to rotate by application of power through the second-shaft servo motor to move the second-shaft guide block.

3. The plasma torch of claim 1, wherein the first-shaft torch feed means further includes:

a first-shaft ball screw coupled to the first-shaft guide block by passing therethrough and linearly moving the first-shaft guide block forward and backward through normal and reverse rotation; and a first-shaft servo motor connected to an end of the first-shaft ball screw and rotating in normal and reverse directions by application of power to rotate the first-shaft ball screw in the normal and reverse directions.

4. The plasma torch of claim 2, wherein:

the second-shaft length adjustment means further includes a second-shaft connection bar rotatably coupled to an end of a second-shaft connection link;

the second-shaft connection link being rotatably coupled to an upper end of a second- shaft support provided at a side of the melter.

5. The plasma torch of claim 1, wherein when the plasma torch operates with reversed polarity, an anode spot is fixed without movement on a surface of the rear electrode.

6. The plasma torch of claim 1, wherein when the plasma arc is generated by a discharge gas injected between the rear and front electrodes, an arc length increases by moving a cathode spot to a desired position through a flow of plasma gas.

7. The plasma torch of claim 1, wherein the rear and front electrodes are made of any one of oxygen-free copper, tungsten, graphite, molybdenum, and silver materials depending on use.

8. The plasma torch of claim 1, wherein the rear and front electrodes are designed to have a multi-bar type structure in which a water-cooled conductive coil designed to allow a maximum current of several hundred amperes or more to flow into the rear and front electrodes is wound several times or more, so that a high speed rotation of an arc spot and current density dispersion are induced by a strong magnetic field generated in an axial direction of the electrodes.

9. The plasma torch of claim 1, wherein the rear and front electrodes have a protruding or depressed structure, the rear electrode being formed in a hollow shape in which an end thereof is blocked and an inside thereof is hollow, and the front electrode being formed in a nozzle shape in which opposite ends thereof are open.

10. The plasma torch of claim 1, wherein the plasma torch operates as a transferred torch, a non-transferred torch, or a combination torch to perform treatment of non-conductive waste or conductive waste.

11. The plasma torch of claim 1, wherein the plasma torch is initially ignited by using argon gas as a discharge gas and is switched to a non-transferred mode by using nitrogen gas, the plasma torch operating in a transferred or combination mode with a current equal to or greater than a certain level.

12. The plasma torch of claim 1, wherein the plasma torch performs an operation for destroying or melting a waste drum charged into the melter.

13. The plasma torch of claim 1, wherein the plasma torch is configured to be movable during operation thereof.

14. The plasma torch of claim 1, wherein the plasma torch is configured to be freely adjustable in movement distance inside the melter during operation thereof.

15. The plasma torch of claim 1, wherein the plasma torch is configured to be hermetically and rotatably coupled to the melter by using a ball joint bearing.

16. The plasma torch of claim 1, wherein reversed polarity and straight polarity operations of the plasma torch are freely switchable with each other during operation of the torch.

17. A plasma torch with a structure capable of performing reversed polarity/straight polarity operation, wherein the plasma torch is coupled to a melter and melts a waste material such as radioactive waste or industrial waste by generating and sustaining a plasma arc between electrodes, the plasma torch comprising:

a rear electrode provided inside a torch pipe and electrically connected to become one of an anode or a cathode;

a front electrode provided at a front end of the torch pipe at a position adjacent to a front end of the rear electrode and electrically connected to become another one of the anode or the cathode;

a first-shaft torch feed means linearly feeding the plasma torch; and a second-shaft torch rotation angle adjustment means adjusting a rotation angle of the plasma torch when the plasma torch is coupled to the melter;

wherein electrical connections of the rear and front electrodes are switchable with each other so that the plasma torch operates as a reversed polarity plasma torch or a straight polarity plasma torch;

wherein the first-shaft torch feed means includes:

a first-shaft linear motion (LM) guide guiding the plasma torch to move linearly;

a first-shaft guide block provided on the first-shaft LM guide to be movable linearly and fixedly supporting on an upper portion thereof the plasma torch;

a first-shaft ball screw coupled to the first-shaft guide block by passing therethrough and linearly moving the first-shaft guide block forward and backward through normal and reverse rotation; and a first-shaft servo motor connected to an end of the first-shaft ball screw and rotating in normal and reverse directions by application of power to rotate the first-shaft ball screw in the normal and reverse directions; and wherein the second-shaft torch rotation angle adjustment means includes:

a second-shaft support having a predetermined height and provided at a side of the melter;

a second-shaft connection link rotatably coupled to an upper end of the second-shaft support;

a second-shaft length adjustment means rotatably coupled to an end of the second-shaft connection link, and adjusting an angle of the plasma torch through length adjustment; and a second-shaft support link rotatably coupled at opposite ends thereof to an end of the second-shaft length adjustment means and to a side of the melter, and supporting the first-shaft torch feed means.

18. The plasma torch of claim 17, wherein the second-shaft length adjustment means includes:

a second-shaft connection bar rotatably coupled to an end of the second-shaft connection link;

a second-shaft LM guide coupled to the second-shaft connection bar;

a second-shaft guide block provided on the second-shaft LM guide to be movable linearly forward and backward;

a second-shaft moving bar provided on the second-shaft guide block and rotatably coupled to the second-shaft support link;

a second-shaft ball screw coupled to the second-shaft guide block by passing therethrough and linearly moving the second-shaft guide block forward and backward through normal and reverse rotation; and a second-shaft servo motor connected to the second-shaft ball screw, and rotating in the normal and reverse directions by application of power to rotate the second-shaft ball screw in the normal and reverse directions.

19. A melter, wherein the melter has a first plasma torch and a second plasma torch, each of the first plasma torch and the second plasma torch having a structure capable of performing reversed polarity/straight polarity operation and being configured to melt a waste material such as radioactive waste or industrial waste by generating and sustaining a plasma arc between electrodes, each of the first plasma torch and the second plasma torch comprising:

a rear electrode provided inside a torch pipe and electrically connected to become one of an anode or a cathode;

a front electrode provided at a front end of the torch pipe at a position adjacent to a front end of the rear electrode and electrically connected to become another one of the anode or the cathode; and a first-shaft torch feed means configured to linearly feed the first plasma torch or the second plasma torch forward and backward in a direction parallel to a lengthwise direction of the first plasma torch or the second plasma torch, wherein the first-shaft torch feed means includes:

a first-shaft linear motion (LM) guide guiding the first plasma torch or the second plasma torch to move linearly; and a first-shaft guide block provided on the first-shaft LM guide to be movable linearly and fixedly supporting on an upper portion thereof the plasma torch;

wherein a surface of the first-shaft guide block contacts a surface of the plasma torch; and wherein electrical connections of the rear and front electrodes are switchable with each other so that each of the first plasma torch and the second plasma torch operates as a reversed polarity plasma torch or a straight polarity plasma torch;

the first plasma torch and the second plasma torch operating by one power source and operating in an operation state and a pre-heating state, respectively, such that when one of the first plasma torch or the second plasma torch stops operation or an output thereof decreases, another one of the first plasma torch or the second plasma torch operates by replacing the one of the first plasma torch or the second plasma torch.

* * * * *